United States Patent [19]

Schartz

[11] Patent Number: 4,522,570

[45] Date of Patent: Jun. 11, 1985

[54] PERISTALTIC PUMP APPARATUS

[76] Inventor: Charles O. Schartz, R.R. 2, Larned, Kans. 67550

[21] Appl. No.: 512,807

[22] Filed: Jul. 11, 1983

[51] Int. Cl.[3] ..... F04B 43/12

[52] U.S. Cl. ..... 417/475; 417/477

[58] Field of Search ..... 417/475, 477, 426

[56] References Cited

U.S. PATENT DOCUMENTS

| | | | |
|---|---|---|---|
| 3,055,551 | 9/1962 | Johnson | 417/475 X |
| 3,122,103 | 2/1964 | Ormsby | 417/475 |
| 3,816,033 | 6/1974 | Fried et al. | 417/477 X |
| 3,832,096 | 8/1974 | Gelfand | 417/475 |
| 3,951,570 | 4/1976 | De Biaggi | 417/475 X |

FOREIGN PATENT DOCUMENTS

| | | | |
|---|---|---|---|
| 705148 | 12/1979 | U.S.S.R. | 417/475 |

*Primary Examiner*—Richard E. Gluck

*Attorney, Agent, or Firm*—Henderson & Sturm

[57] ABSTRACT

A peristaltic pump (10) having two side-by-side mounted pump cells (11 and 12). Each pump cell includes a plurality of rollers (16) that contact an array of hoses (19 and 21) to urge fluid substances through said hoses in a peristaltic pumping action. A drive unit (24) causes the operable rotation of the first pump cell (11), and geared interaction between the two cells causes the second pump cell (12) to operably rotate. The gears (13) include nylon bearing surfaces (32) for the rollers (16).

4 Claims, 9 Drawing Figures

PERISTALTIC PUMP APPARATUS

TECHNICAL FIELD

This invention relates generally to peristaltic pumps, and in particular to peristaltic pumps utilized in conjunction with liquified fertilizer.

BACKGROUND ART

Peristaltic fertilizer pumps are well known in the art. Such pumps typically include two to twenty-four outlets per pump. These pumps usually include a drive unit, a rotating member connected to the drive unit, and a plurality of rollers rotatably connected to the rotating member. As the rotating member rotates, the rollers squeezable contact a plurality of hoses to urge the fertilizer therethrough.

Such prior art mechanisms have certain difficulties associated with their use. For instance, the rollers are typically connected to the rotating member by ball and needle bearings. Such bearings can be ruined if liquid fertilizer contacts them.

A more serious problem, however, involves the securing of one pump to another. An operator may wish to spread fertilizer through forty-eight outlets. The largest pump currently made only has twenty-four. Therefore, two pumps of this size must be connected together. The prior art pumps must be connected in series to accomplish this. When so connected, the length of the combined units can be greater than the available mounting space provided on the farm implement equipment. Therefore, the operator must usually accept some unsatisfactory compromise in order to complete fertilization of the field.

DISCLOSURE OF INVENTION

The instant invention provides a peristaltic pump apparatus that eliminates the need for ball and needle bearings and that further provides for parallel mounted pump cells that minimize the longitudinal length required to gain a desired number of outlets.

This pump includes a drive unit to provide rotational motion, and a first pump cell that includes two rotating members joined by a shaft and a plurality of rollers connected between the two rotating members. The rollers are mounted eccentrically with respect to the rotating member's axis of rotation. The rotating members include bearings formed therein for receiving the rollers, thereby eliminating the need for ball and needle bearings.

The pump apparatus also includes a second pump cell that includes a second pair of rotating members that are joined by a shaft and that have a plurality of rollers connected therebetween.

The rotating members for both cells may be provided by use of a molded nylon gear. The two gears of the first cell are positioned to enmesh the teeth of the two gears of the second cell. Therefore, when the drive unit causes the two rotating members of the first pump cell to rotate, the rotating members of the second pump cell will rotate as well.

A manifold for carrying the liquid fertilizer may be disposed below and between the two pump cells. A plurality of hoses are affixed to both sides of the manifold. One set of hoses passes underneath and around the first pump cell and the remaining hoses pass underneath and around the second pump cell. A backing plate may be positioned about both sets of hoses, such that when the rollers contact the hoses, the hoses will be prevented from flexing outwardly.

Finally, two end plates are provided to encompass and hold in place the four rotating members. These end plates include bosses formed thereon to receive the hubs of the rotating members.

BEST MODE FOR CARRYING OUT THE INVENTION

Figure 6:
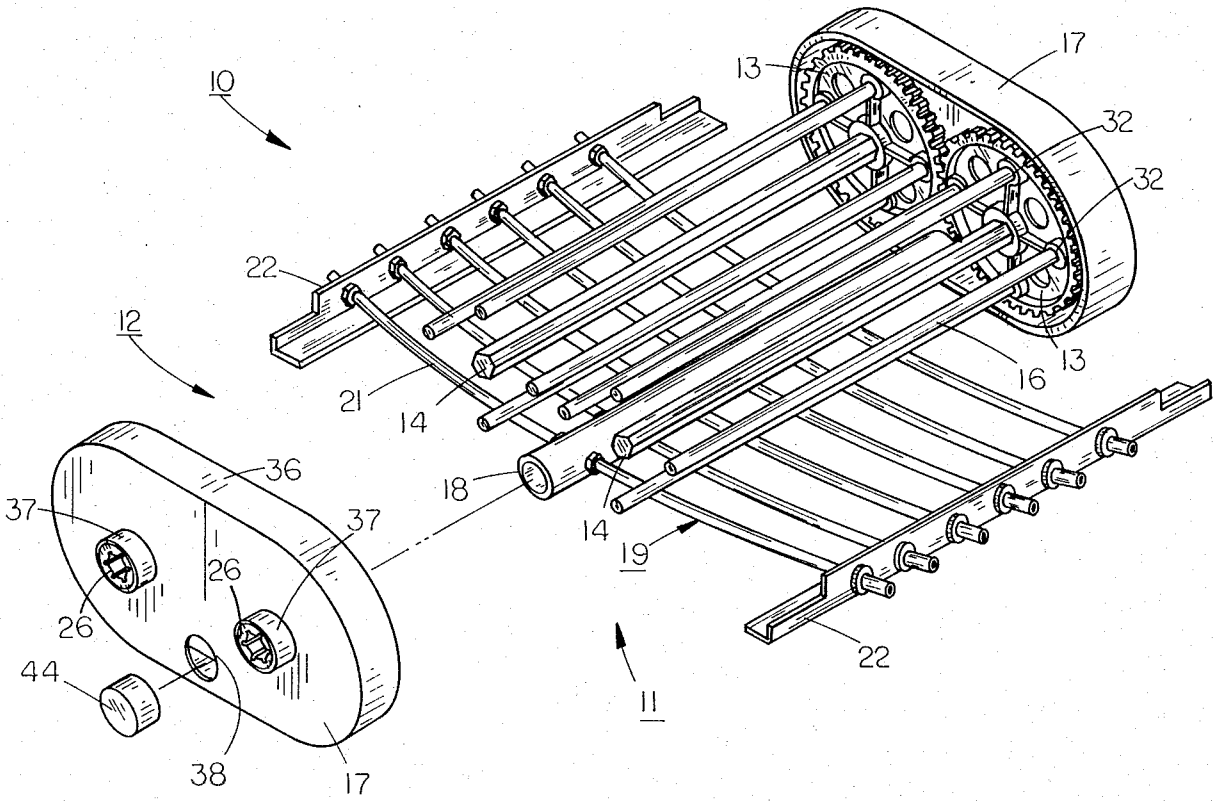
FIG. 6 provides a perspective view of the apparatus.

Referring now to the drawings, and in particular to FIG. 6, the apparatus may be seen as depicted generally by the numeral 10. The apparatus (10) includes a first pump cell (11) and a second pump cell (12).

Each pump cell (11 and 12) includes a pair of rotating members (13) connected by a shaft (14). A plurality of rollers (16) are rotatably mounted between the rotating members (13). A pair of end plates (17) serve to house the rotating members (13).

The apparatus (10) also includes a manifold (18) having a first hose array (19) and a second hose array (21) connected thereto. Each hose array (19 and 21) connects to an output rack (22) that may then be connected to the end plates (17). Finally, the apparatus (10) includes a pair of backing plates (23) (FIG. 8) and a drive unit (24). Each of the above members will now be described in more detail in seriatim fashion.

Figure 1:
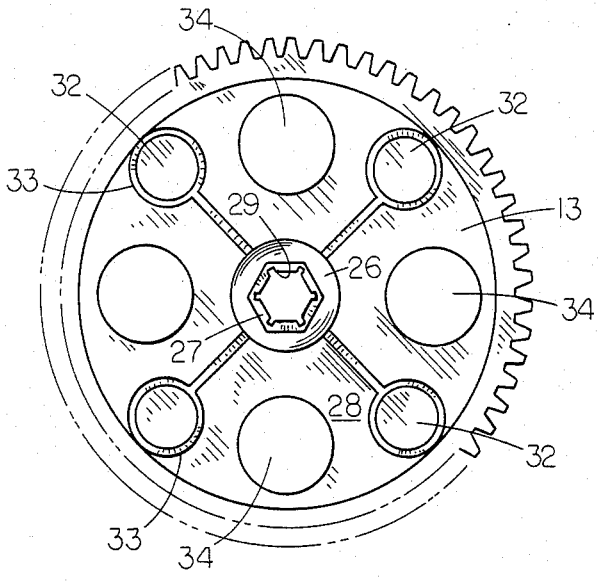
FIG. 1 is an enlarged side elevational view of a gear comprising a rotating member.
Figure 2:
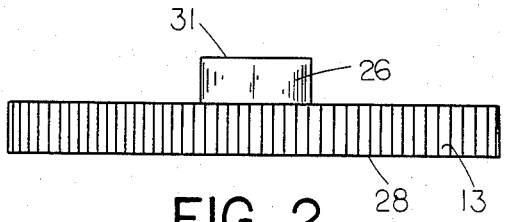
FIG. 2 provides an enlarged top plan view of the gear depicted in FIG. 1.

Referring to FIG. 1, each rotating member may be comprised of molded nylon configured in the shape of a gear having a centrally disposed hub (26) (FIG. 2) formed thereof. The hub (26) extends outwardly from the main body of the gear for operable interaction with appropriate recesses provided in the end plates (17).

Figure 3:
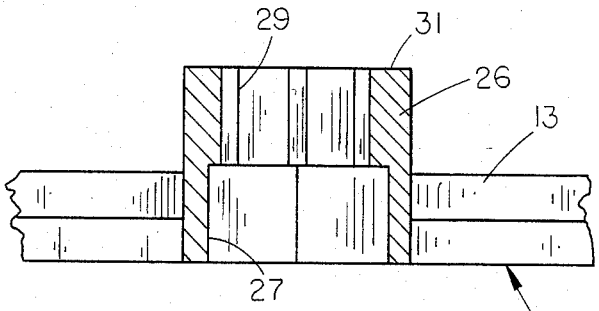
FIG. 3 provides an enlarged, detailed, sectioned top plan view of the gear depicted in FIG. 1.

Referring to FIGS. 1 and 3, the hub has two channels formed therethrough. The first channel (27) has a substantially hexagon cross section. This channel (27) opens to the inside surface (28) of the gear and serves to receive the hexagon shaped drive shaft (14) described below. The remaining channel (29) has a splined cross section. This channel (29) opens to the exterior surface (31) of the rotating member (13). This second channel (29) serves to operably engage the drive unit (24) described below.

In the embodiment depicted (see FIG. 3), the hexagon channel (27) and the splined channel (29) contact to form a contiguous pathway. Such continuity, however, does not comprise a mandatory aspect of the invention. Rather, the channels (27 and 29) could be segregated from one another.

Referring again to FIG. 1, the rotating member (13) has formed on the interior surface (28) thereon a plurality of bearing surfaces (32). Such bearing surfaces (32) are substantially circular in cross section to receive the rollers (16) described below. The bearing surfaces (32) may be formed of raised walls (33) disposed on the interior surface (28) of the rotating member (13).

Finally, if desired, a plurality of holes (34) can be formed through the rotating member (13) to reduce weight.

Figure 4:
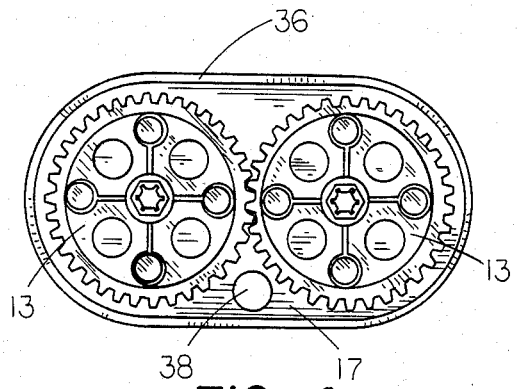
FIG. 4 comprises a side elevational view of two gears in an end plate.

Referring to FIGS. 4 and 6, the end plates (17) may be formed of shallow containers having an interior periphery suitable for receiving two side-by-side rotatably mounted rotating members (13). The end plates (17) include a flange (36) disposed about the periphery thereof for use in retaining the rotating members (13) and for protecting the rotating members (13) from debris or other material which might tend to clog or impede their operation.

Referring to FIG. 6, each end plate (17) includes two hub receiving bosses (37) formed outwardly thereof. The hub (26) of a rotating member (13) may be rotatably disposed within each boss (37).

The end plate (17) also includes a hole (38) disposed therethrough for receiving the manifold (18) described below.

Figure 5:
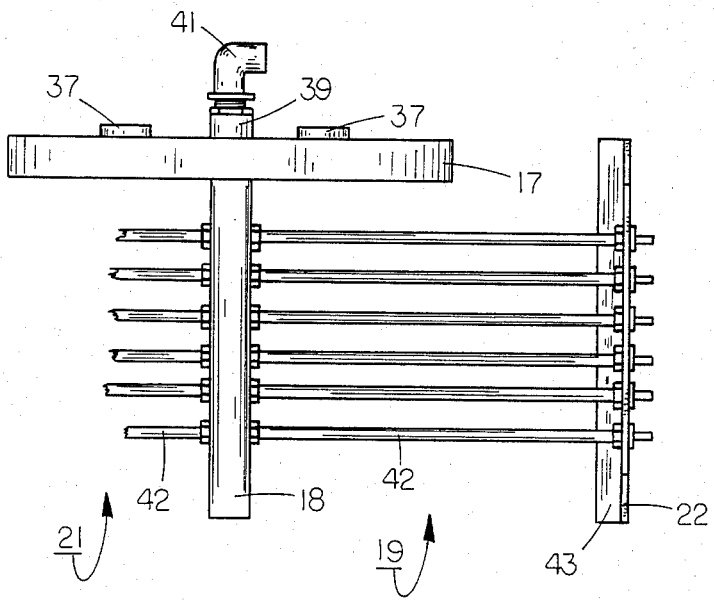
FIG. 5 provides a top plan view of an end plate, the manifold and one set of hoses.

Referring to FIG. 5, the manifold (18) may be comprised of a length of PVC tubing or the like. This manifold has a first end (39) that includes a connecting unit (41) to connect the manifold (18) to a source of liquid fertilizer or other fluid substance (not shown). This end (39) of the manifold (18) may be disposed through the hole (38) provided therefor in the end plate (17).

The manifold (18) further includes a plurality of holes disposed therethrough on either side thereof. Each hole connects appropriately to a hose (42). In FIG. 5, the first hose array (19) has been completely shown while only a portion of the second hose array (18) has been depicted. Since both hose array (19 and 21) are substantially similar, only the first (19) need be described in detail.

Each hose may be formed of a flexible substance that can be selectively compressed. The end of each hose (42) connects to a metal rack (43) that comprises the output array (22). The output of each hose (42) may then be connected as desired to other output feed mechanisms.

Referring to FIG. 6, each bearing surface (32) of each rotating member (13) operably receives a roller (16) that may be formed of a solid metal cylinder. In the embodiment depicted, each rotating member (13) will accomodate four such rollers (16). A greater or fewer number of rollers (16) could be provided as necessary to accommodate a particular application. A hexagon shaped shaft (14) may be disposed within the hexagon shaped channel (27) provided in the hub (26) of the rotating member (13).

The remaining ends of the rollers (16) and of the shaft (14) may be similarly connected to a second rotating member (13) disposed parallel to and concentrically with the first rotating member (13) described above.

The rotating members (13) rollers (16), and shaft (14) of the second pump cell (12) may be similarly configured.

The manifold (18) may be disposed through the holes (38) provided therefor in the end plates (17). In order to prevent the pumped substance from flowing out the end of the manifold (18), an end cap (44) may be disposed thereabout.

The hoses of the first hose array (19) are then disposed underneath and around the rollers (16) that comprise the first pump cell (11). Similarly, the hoses of the second hose array (21) are disposed underneath and around the rollers (16) of the second pump cell (12).

Figure 7:
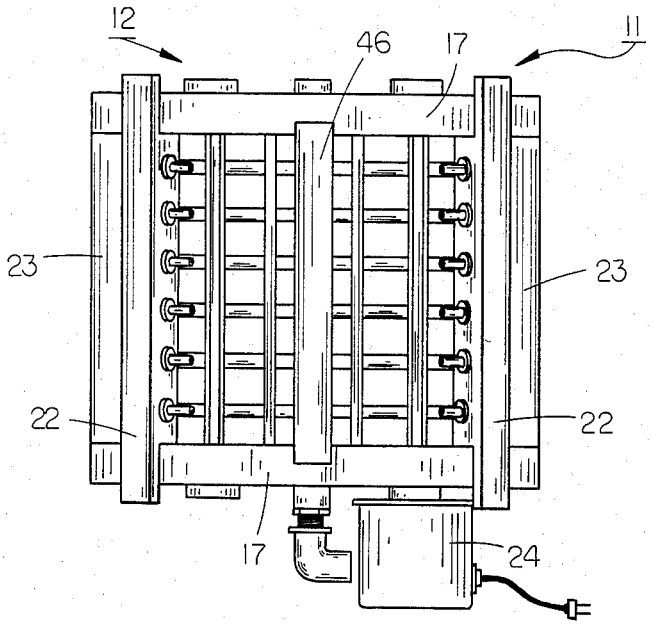
FIG. 7 provides a top plan view of the apparatus.

With reference to FIG. 7, the output array rack (43) connects to the end plates (17) by any appropriate means. In addition, a support beam (46) may be disposed between the two end plates (17) and affixed thereto by any appropriate means.

Figure 8:
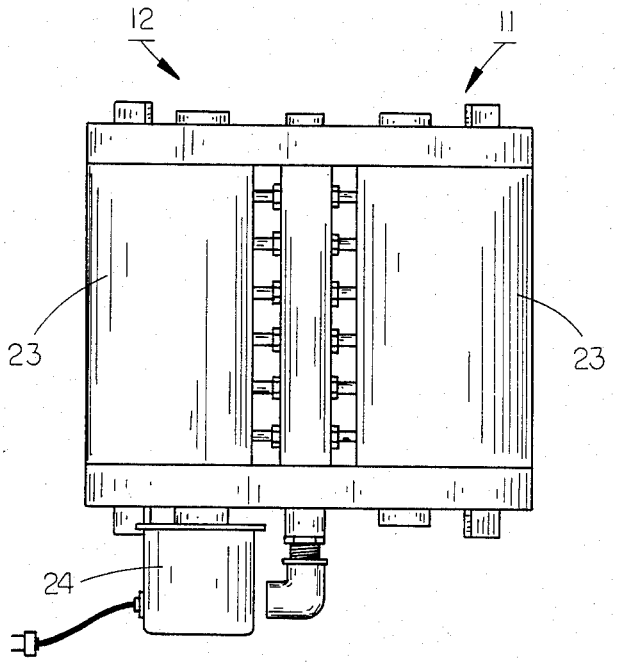
FIG. 8 provides a partial top plan view of another embodiment of the apparatus.

Referring to FIG. 8, backing plates (23) may be disposed underneath and around the sides of both pump cells (11 and 12). Such backing plates serve to support the hoses (42) of both hose arrays (19 and 21) during operation of the apparatus (10). Finally, a drive unit (24) (such as a Durst Orbmark 32W25 pump motor with a No. 32WZFSPPCWH control valve) may be connected to the apparatus (10) by inserting the rotating shaft thereof into the splined channel (29) of the first rotating member (13) of the first pump cell.

During operation, the drive unit (24) imparts rotational movement to the rotating member (13) that connects directly to its shaft. This causes the rotating member (13) to rotate. Movement of this rotating member (13) will be imparted to the remaining rotating member (13) of the first pump cell by the hexagon shaped drive shaft (14) that connects the two.

As these rotating members rotate, the rollers (16) rotate as well about the axis of rotation. As they rotate, they come in contact with the hoses (42) of the first hose array (19). The rollers (16) squeeze the hoses (42) against the backing plates (23). This action urges the fluidic contacts of the hoses to move therethrough and out the outputs provided.

Rotational movement of the rotating members (13) of the first pump cell (11) will cause the rotating members (13) of the second pump cell (12) to rotate as well, due to interaction between the gear teeth surrounding the periphery of each rotating member (13). Hence, the rollers (16) of the second pump cell (12) will operate as in the first pump cell (11) to urge liquid substances through the second hase array (21).

Any number of outlets can be provided on a particular manifold. More importantly, however, the apparatus (10) disclosed provides twice the number of outlets per unit of length as prior art pumps provide. Hence, such a pump may find suitable application in physical locations where prior art mechanisms are inappropriate.

It should also be understood that the apparatus (10) can be serially connected to additional pump units if desired. The manifold (18) need only be extended further and an appropriate shaft connected between a rotating member (13) of the first pump (10) and the second.

It will further be appreciated that the rotating members (13) of the apparatus (10) serve to provide a bearing surface (32) for the rollers (16) that avoids the use of ball and needle bearings. The nylon material from which the bearing surfaces (32) of the rotating members (13) are comprised will not be affected in any detrimental way be exposed to liquid fertilizer or the like.

Figure 9:
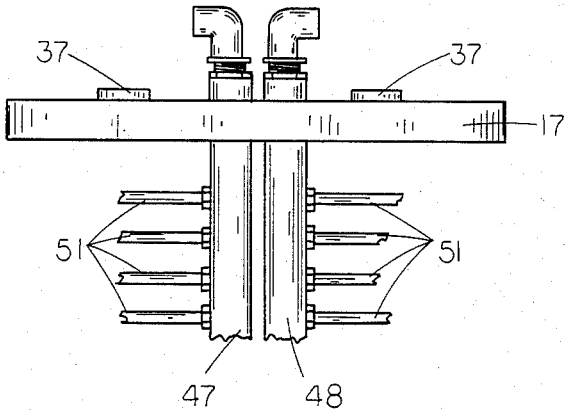
FIG. 9 provides a top plan partial view of an alternative embodiment for the manifold.

Referring to FIG. 9, an alternative embodiment of the apparatus (10) could utilize a dual manifold system. More particularly, two separate manifolds (47 and 48) could be provided. Each such manifold (47 and 48) could have a plurality of output hoses (51) associated therewith in a manner identical to that described above. In use, however, an operator would have the option of pumping two separate substances through the pumps, or substances of differing potentcy mixtures. For instance, an operator might wish to pump liquid fertilizer through one cell of the pump and herbicide through the remaining cell.

Obviously, numerous modifications and variations of the present invention are possible in light of the above teachings. It is therefore to be understood that within the scope of the appended claims, the invention may be practiced otherwise than as specifically described therein.

I claim:

1. In a peristaltic pump for pumping a substantially fluid substance from a source of said fluid substance, said pump including a first pump cell comprising a first set of at least one hose having one end operably connectable to a source of substantially fluid substance and a second end serving as an output for any substantially fluid substance moving therethrough, a rotating drive apparatus, first and second rotating members, said first rotating member being operably connected to said rotating drive apparatus, and a first plurality of rollers operably connected between said first and second rotating members, such that as said first rotating member rotates, said first plurality of rollers operably contact said first set of at least one hose to urge a substantially fluid substance to move therethrough to said output, an improvement comprising a second pump cell, said second pump cell disposed substantially beside said first pump cell, said second pump cell including:

a second set of at least one hose having one end operably connectable to a source of a substantially fluid substance and a second end serving as an output for any substantially fluid substance moving therethrough;

a third rotating member being operably connected to said first rotating member such that when said first rotating member rotates, said third rotating member also rotates, and a fourth rotating member; and a second plurality of rollers operably connected between said third and fourth rotating members; such that as said first rotating member rotates, said third rotating member rotates and thereby causes said second plurality of rollers to operably contact said second set of at least one hose to urge a substantially fluid substance to move therethrough to said output;

wherein said first and second plurality of rollers are comprised of rollers being substantially circular in cross section, and wherein said first and third rotating members are substantially circular in shape and have gear teeth disposed about the peripheries thereof, wherein said first and third rotating members physically contact one another such that the gear teeth disposed about the peripheries thereof are enmeshed, such that rotation of said first rotating member will cause said third rotating member to rotate.

2. The improvement of claim 1 wherein said first through fourth rotating members have bearing surfaces formed thereon comprised of nylon.

3. The improvement of claim 1 wherein said pump includes a manifold disposed between said first and second pump cells.

4. The improvement of claim 1 wherein said first rotating member includes a first centrally disposed channel formed at least partially therethrough having a substantially hexagon shaped cross section, and further includes a second centrally disposed channel formed at least partially therethrough having a substantially splined cross section.

* * * * *